US005458472A

United States Patent [19]

Kobayashi et al.

[11] Patent Number: 5,458,472

[45] Date of Patent: Oct. 17, 1995

[54] SCROLL TYPE COMPRESSOR HAVING THRUST REGULATION ON THE ECCENTRIC SHAFT

[75] Inventors: Hisao Kobayashi; Izuru Shimizu; Kiyohiro Yamada; Tetsuhiko Fukanuma, all of Kariya, Japan

[73] Assignee: Kabushiki Kaisha Toyoda Jidoshokki Seisakusho, Kariya, Japan

[21] Appl. No.: 143,346

[22] Filed: Oct. 26, 1993

[30] Foreign Application Priority Data

Oct. 28, 1992 [JP] Japan ..... 4-290571

[51] Int. Cl.[6] ..... F04C 18/04

[52] U.S. Cl. ..... 418/55.5; 418/57; 418/151

[58] Field of Search ..... 418/55.1, 55.5, 418/57, 151

[56] References Cited

U.S. PATENT DOCUMENTS

| | | | |
|---|---|---|---|
| 4,457,676 | 7/1984 | Hiraga | 418/55.5 |
| 4,580,956 | 4/1986 | Takahashi et al. | 418/55.5 |
| 4,892,469 | 1/1990 | McCullough et al. | 418/55.5 |
| 4,932,845 | 6/1990 | Kikuchi et al. | 418/55.5 |

*Primary Examiner*—John J. Vrablik

*Attorney, Agent, or Firm*—Brooks Haidt Haffner & Delahunty

[57] ABSTRACT

A mechanism for allowing the orbital movement of an orbiting scroll with respect to a fixed scroll in a scroll type compressor which prevents the orbiting scroll from rotating around its own axis is disclosed. The orbiting scroll is eccentrically attached to a rotary shaft supported by a housing that encases the fixed and orbiting scrolls. A compression chamber is defined by the interfitting between the orbiting scroll and the fixed scroll. During the course of the orbiting scroll's rotation around the center axis line of a rotary shaft, the volume of a compression chamber decreases as the rotation progresses. Refrigerant gas in the compression chamber is compressed in this manner as the constant volume of gas within the compression chamber decreases in size according to the progression of the rotating spiral member. A balancing weight disposed on the eccentric shaft compensates for dynamic unbalancing generated as the orbiting scroll makes an orbital movement due to the rotation of the rotary shaft. This balancing weight engages a bushing which supports the orbiting scroll. A mechanism for automatically adjusting the radius of the orbital movement is disposed between the rotary shaft and the balancing weight. A spring for restricting the shifting on the eccentric shaft of both the weight and the bushing in the thrust direction is disposed between the weight and the bushing.

13 Claims, 10 Drawing Sheets

SCROLL TYPE COMPRESSOR HAVING THRUST REGULATION ON THE ECCENTRIC SHAFT

BACKGROUND OF THE INVENTION

1. Field of the Invention

The present invention relates generally to a scroll type compressor. More specifically, the present invention relates to an improved mechanism for suppressing noise generated by an orbiting scroll member as it rotates around a fixed scroll member to generate compressed gas.

2. Description of the Related Art

Conventional scroll type compressors generally include a standard structure having two offset scroll members. Both scroll members have spiroidal or involute spiral members attached to a circular end plate. The spiroidal members are interfitted and nestled with each other so that as an orbiting scroll member rotates around a fixed scroll member a gas chamber is formed by the interfitting spiroidal members. During the course of the orbiting scroll's rotation, the volume and location of the gas chamber is defined by the interfitting scroll members and decreases as the rotation progresses. Gas introduced into the gas chamber is compressed when the gas chamber decreases in volume according to the progression of the rotating spiral member. Japanese Examined Patent Publication No. 59-215984 discloses a compressor of this type herein generally described by reference to FIGS. 13 through 17. As shown in FIG. 13, a fixed scroll 112 is secured by bolts to housing 111 and comprises a base plate 112*a* integrally formed with a perpendicularly connected spiral member 112*b*. At the front side of the housing 111, an eccentric shaft 114 is operably connected to a rotary shaft 113 at a predetermined radial distance from the axis of the shaft 113. A bushing 115 is likewise rotatably supported by the eccentric shaft 114. An orbiting scroll 117 is operably connected to the bushing 115, via radial bearings 116. The orbiting scroll 117 includes a base plate 117*a*, a spiral member 117*b* perpendicularly connected to the plate 117*a*, and a generally cylindrical shaped boss 117*c* integrally formed with the plate 117*a* at the rear surface of the plate 117*a*. The boss 117*c* is fitted on to the bushing 115. As shown in FIG. 15, both spiral members 112*b* and 117*b* are interfitted and nestled with each other so as to define gas chambers P wherein at least two points of contact are defined between surfaces 112*b* and 117*b*. Each compression chamber P is defined by the interfitting spiral members 112*b* and 117*b* together with the base plates 112*a* and 117*a*.

When the rotary shaft 113 rotates, the eccentric shaft 114 moves in a circumference such that the distance between a center axis line $O_1$ and a center axis line $O_2$ forms a radius $r_1$ of rotation of shaft 114 as shown in FIG. 16. Since the eccentric shaft 114 is separated from the center axis line $O_3$ (i.e., same center axis line of the orbiting scroll 117) by a predetermined distance, the orbiting scroll 117 moves such that the distance between the center axis line $O_1$ of the rotary shaft 113 and a center axis line $O_3$ of bushing 114 is a radius $r_2$. During the course of the orbiting motion of the scroll 117, the volume and location of the each compression chamber P, defined by the interfitting spiral members, decreases from the outer to inner portions thereof as shown in FIG. 15. Refrigerant gas is compressed in this manner when a particular amount of gas within the compression chamber P decreases in volume according to the progression of the moving spiral member 117*b*. The compressed refrigerant gas is then discharged through a discharge port 112*c* which is formed at a center portion of the base plate 112*a* into a discharge chamber.

Unfortunately with conventional scroll type compressors, the rotation of the rotary shaft 113 produces a tendency in orbiting scroll 117 to rotate around its own axis (hereinafter referred to as self rotation). This tendency produces a corresponding decrease in the ability of the compressor to efficiently compress gas. Given this tendency, it is highly desirable to limit or prevent the self rotation of the orbiting scroll 117. As shown in FIG. 13, an anti-self-rotation mechanism 118, disposed between the base plate 117*a* of the scroll 117 and the inner front surface of the housing 111, is designed to prevent the self rotation of the scroll 117. In addition, the mechanism 118 functions to transmit the compression reaction force from the scroll 117 to the inner wall of the housing 111. Mechanism 118 also functions to set the maximum radius $r_2$ for the rotation of the scroll 117.

A center of gravity of the orbiting scroll 117 lies on the center axis line $O_3$ rather than on the center axis line $O_1$ of the rotary shaft 113 due to the design of the eccentric shaft 114. Thus when the scroll 117 rotates, the centrifugal force produced by the rotation creates a condition where scroll 117 becomes dynamically unbalanced. To compensate for this unbalancing, a balancing weight 119 is integrally connected to the bushing 115. This weight generates a counter centrifugal force that opposes or cancels the centrifugal force acting on the scroll 117.

The spiral member 112*b* of the fixed scroll 112 slidably abuts against at least two inner and outer portions of the spiral member 117*b*. As illustrated in FIG. 15, the abutting portions T, between the spiral members 112*b* and 117*b*, move from the outer sides of the spiral members to the central portions thereof. If the portions T are able to advance in their rotation without a separation occurring between abutting members, the compression chambers P can be maintained with desirable air-tight seals.

Normally, the manufacturing and design tolerances allowed between fixed and orbiting scrolls 112 and 117 prevent the spiral members 112*b* and 117*b* from being damaged due to any occasional and abnormally high pressure generated in either compression chamber P. However, if the orbital radius $r_2$ of the scroll 117 were to be fixed, the urging force of the spiral member 117*b* against the spiral member 112*b* would be insufficient to maintain an adequate seal between spiral members 112*b* and 117*b*. Consequently, a mechanism for automatically adjusting the orbital radius $r_2$ of the scroll 117 is disposed between the rotary shaft 113 and bushing 115. This allows the orbit of scroll 117 to be shifted by a predetermined amount in order to maintain a sufficient force and consequent seal between spiral members 112*b* and 117*b*.

The mechanism for adjusting the radius $r_2$ will now be described with reference to FIGS. 16 and 17. In FIG. 17, an adjusting pin 120 is connected to the bushing 115 which corresponds to the center axis line $O_3$ of the bushing 115. The pin 120 is inserted into an adjustment hole 121 formed in the rotary shaft 113 with clearance $C_1$ developed therebetween to allow the pin 120 to reciprocate in a perpendicular direction with respect to the axial direction of the bushing 115.

That is, as shown in FIG. 16, the center axis line $O_3$ of the bushing 115 is reciprocative within the predetermined angle $\theta$ along the circular locus of radius $r_1$ even though center axis line $O_2$ of the eccentric shaft 114 is the center of rotation for bushing 115. As the pin 120 moves within the hole 121, as shown in FIG. 16, the radial distance between the axis line $O_1$ of the rotary shaft 113 and the axis line $O_3$ of the bushing 115, alternates between radius $r_{21}$ and radius $r_{22}$. As a result, the urging force acting between the slidably abutting portions T can be adjustably controlled to allow for proper sealing between members 112*b* and 117*b* and consequently, for the efficient operation of the compressor.

To prevent bushing 115 from disengaging from the shaft 114, a snap ring 122 is fitted to the tip portion of the eccentric shaft 114 as shown in FIG. 17. Clearance $C_2$ permits the bushing 115 and balancing weight 119 to shift along the axial line $O_2$ of the eccentric shaft 114. As a result, when the scroll 117 rotates, the bushing 115 and the balancing weight 119 reciprocate along the axial line of the eccentric shaft 114 due to the presence of the clearance $C_2$. This movement generates noise. When such a conventional scroll type compressor is employed in vehicular air conditioning systems, it is desirable to minimize the noise caused by shifting of bushing 115 and balancing weight 119. Reducing the noise in this way, tends to increase the comfort level of the vehicle's driver and passengers.

SUMMARY OF THE INVENTION

It is therefore an object of the present invention to provide a scroll type compressor which can suppress noise generation when the compressor is operating.

It is another object of the present invention to provide a scroll type compressor which provides a smooth automatic adjustment of the orbital radius of the orbiting scroll.

To achieve this object, the present invention has a moveable scroll connected to a rotary shaft by way of an eccentric shaft, and opposed to a fixed scroll for forming a compression chamber, said moveable scroll being arranged to perform an orbital movement about an axis of the rotary shaft without rotating about its own axis for reducing volume of the compression chamber and compressing gas. The present invention further has a bushing disposed between said eccentric shaft and moveable scroll, a balancing weight mounted on the eccentric shaft for compensating the dynamic imbalance of centrifugal force produced by the orbital movement of the moveable scroll, means for adjusting a radius of said orbital movement, said adjusting means being disposed between the rotary shaft and the moveable shaft, means for holding the bushing and the weight on the eccentric shaft and means for regulating the thrusting movement of the bushing and the weight on the eccentric shaft.

BRIEF DESCRIPTION OF THE DRAWINGS

The features of the present invention that are believed to be novel are set forth with particularity in the appended claims. The invention, together with objects and advantages thereof, may be best understood by reference to the following description of the preferred embodiments, when taken together with the accompanying drawings, in which:

DETAIL DESCRIPTION OF THE PREFERRED EMBODIMENTS

A preferred embodiment of the present invention will now be described in greater detail, with reference to FIGS. 1 through 7.

Figure 4:
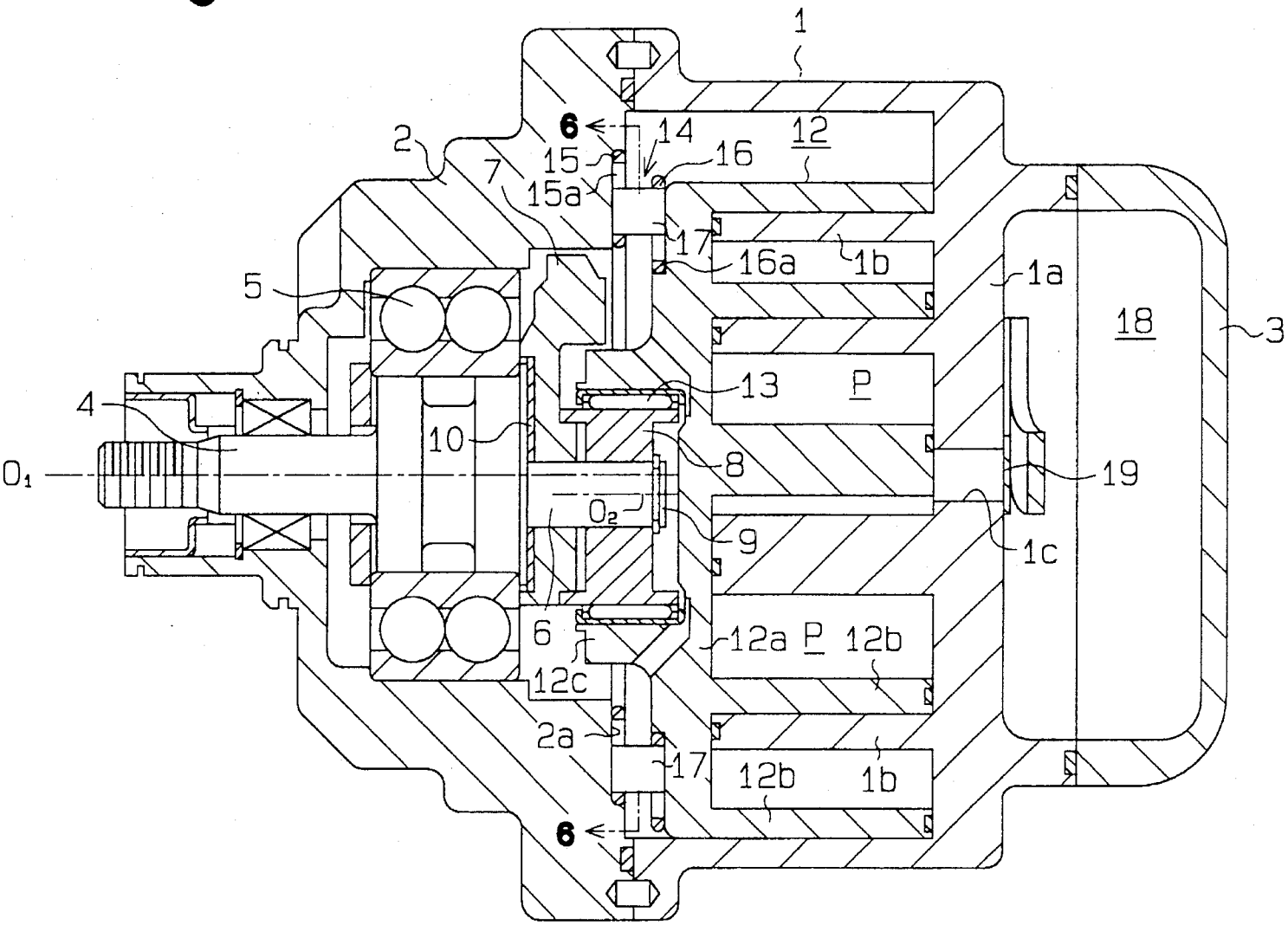
FIG. 4 is a cross-sectional view showing the entire scroll type compressor.

As shown in FIG. 4, a front housing 2 and a rear housing 3 are secured to the front and rear end surfaces of a fixed scroll 1, respectively. Radial bearing 5, toward the front of housing 2, supports a rotary shaft 4 secured to an eccentric shaft 6.

Figure 3:
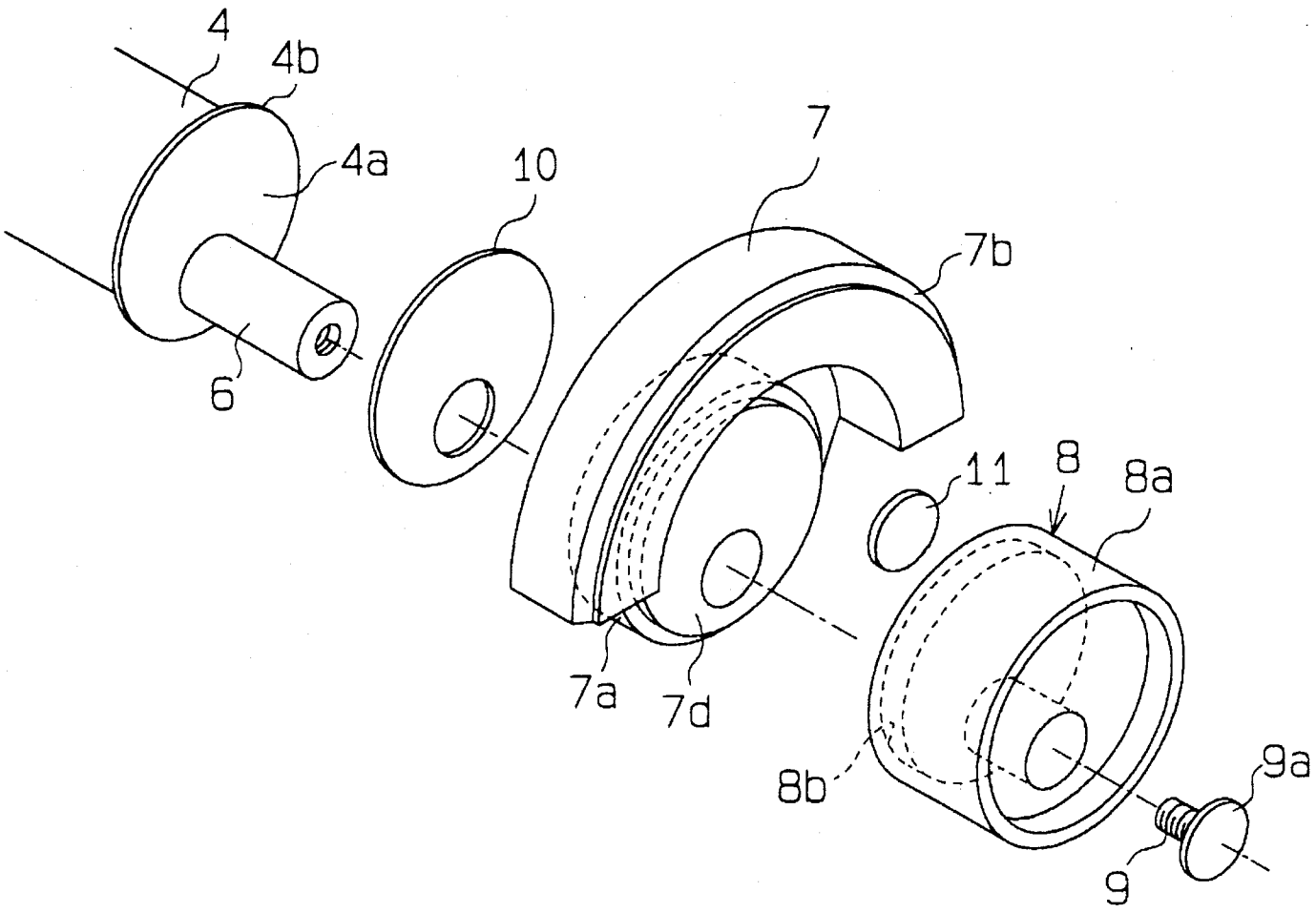
FIG. 3 is a disassembled view in perspective showing the essential portions.

As shown in FIG. 3, a balancing weight 7 formed with a ring member 7*a*, a weight member 7*b* and bushing 8 are rotatably supported by means of the eccentric shaft 6. A screw 9 with a flange 9*a* is screwed into the tip portion of the eccentric shaft 6 for preventing the weight 7 and bushing 8 from disengaging therefrom. A spacer 10 made of a material having a low coefficient of friction and ductility, such as either a sheet of polytetrafluoroethylene (PTFE) or a sheet of gun metal, is interposed between the inner end surface 4*a* of the rotary shaft 4 and the ring member 7*a* of the balancing weight 7. A flat spring 11 is interposed between the balancing weight 7 and the bushing 8, which urges the balancing weight 7 and the bushing 8 on the eccentric shaft 6 along the axial direction of shaft 6. This construction is used in order to prevent the generation of clearance between bushing 8 and shaft 6.

As shown in FIG. 4, a boss 12*c* having a generally cylindrical shape is integrally formed at the central rear portion of a base plate 12*a* of an orbiting scroll 12 which is rotatably fitted on a peripheral surface 8*a* of the bushing 8, via radial bearings 13.

Figure 5:
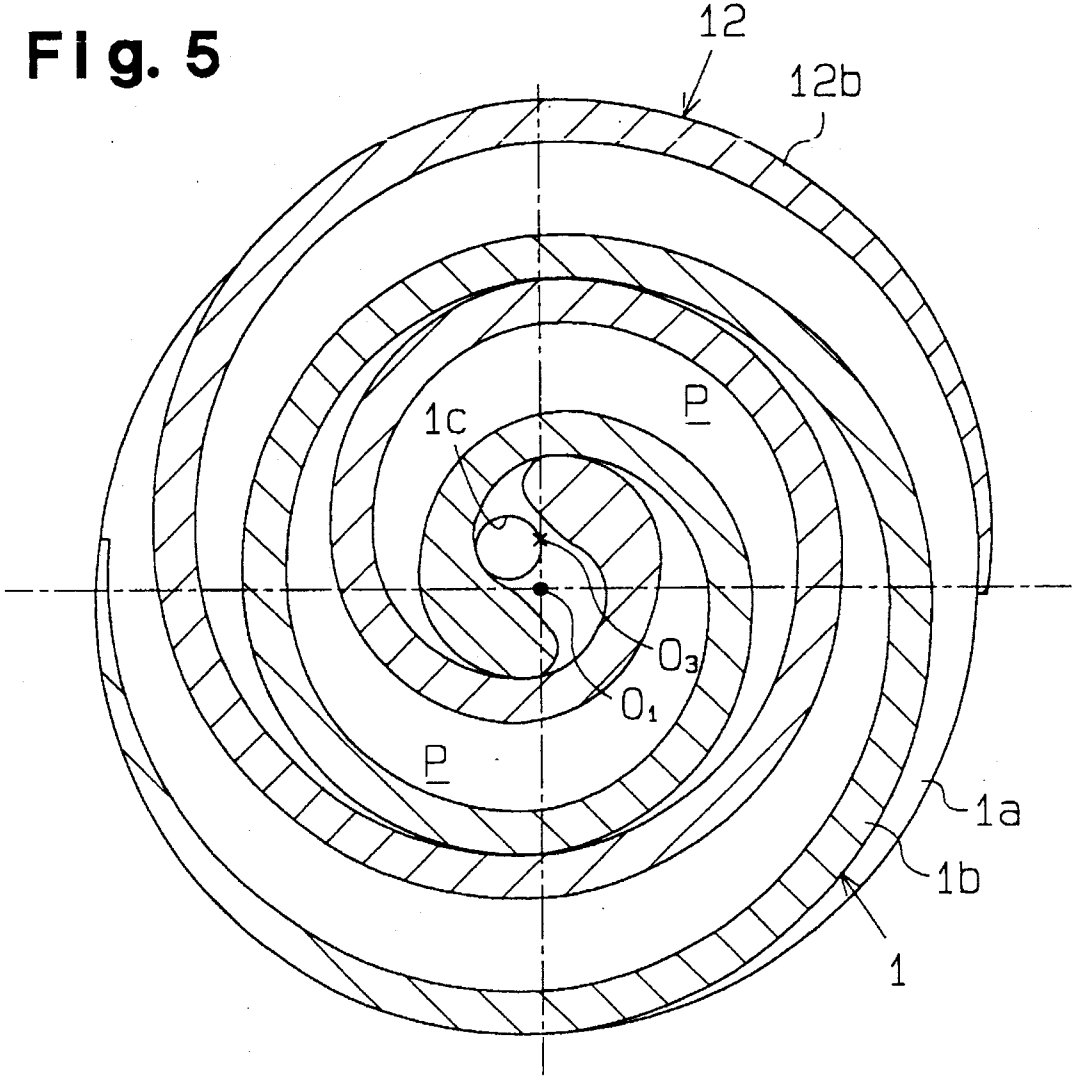
FIG. 5 is a cross-sectional view showing spiral members of the fixed and orbiting scrolls.

As shown in FIGS. 4 and 5, a compression chamber P is defined by base plates 1*a* and 12*a*, and spiral walls 1*b* and 12*b* of both scrolls 1 and 12, respectively. During the course of the orbiting scroll 12 making a predetermined orbital movement, the volume and location of the compression chamber P is decreased and changed as the motion of the scroll 12 progresses. Accordingly, refrigerant gas is compressed in this manner.

As shown in FIG. 4, an anti-self-rotation mechanism 14 for preventing the orbiting scroll 12 from rotating around its axis is interposed between a pressure receiving wall 2*a* of the front housing 2 and the rear surface of the base plate 12*a* of the scroll 12. The mechanism 14 restricts the orbital movement carried out by the scroll 12. Further, this mechanism 14 transmits a compression reaction force acting along the thrust direction to the wall 2*a*, which is generated while the refrigerant gas is being compressed.

Figure 6:
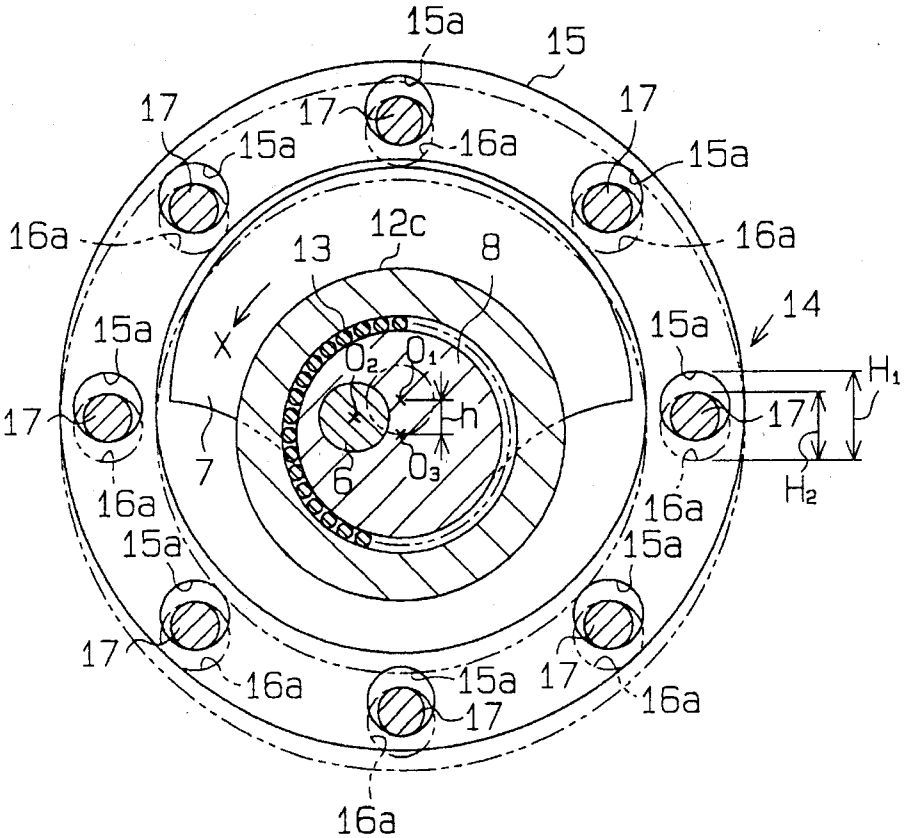
FIG. 6 is a cross-sectional view taken along line 6—6 of FIG. 4.

The mechanism 14 includes a fixed ring 15 and a movable ring 16. The ring 15 is securely fitted to the wall 2*a* of the front housing 2. The ring 16 is secured to the rear surface of the base plate 12*a* of the scroll 12, and moves integrally with the scroll 12. As shown in FIG. 6, a plurality of pockets 15*a* (in this embodiment, eight pockets are provided) are generally circular in shape and equianglarly formed in the circumference of the fixed ring 15 at predetermined intervals. A plurality of pockets 16*a* (in this embodiment, eight pockets are provided) are generally circular in shape and equianglarly formed in the circumference of the movable ring 16 at predetermined intervals, which correspond to the pockets 15*a*, respectively. Rod shaped receiving pressure rollers 17 are inserted into the associated pockets 15*a* and 16*a*, respectively. The radius of the orbital movement made by the scroll 12 is regulated by the pockets 15*a* and 16*a*, and rollers 17. Each peripheral surface at the front side of the rollers 17 rotates along the inner peripheral surface of the associated pocket 15*a*. Further, each peripheral surface at the rear side of the rollers 17 rotates along the inner peripheral surface of the associated pocket 16*a*. Furthermore, an end surface at the front side of each roller 17 slidably contacts the associated wall 2*a*. An end surface at the rear side of the roller 17 slidably contacts the rear surface of the base plate 12*a*. The reaction force received by the scroll 12 and which acts along the thrust direction due to the refrigerant gas compression is transmitted to the wall 2*a*, via the rollers 17. The operation of the mechanism 14 will be described afterward.

As shown in FIGS. 4 through 7, a center axis line $O_1$ of the rotary shaft 4 is the center of the orbit made by the scroll 12. A center axis line $O_2$ of the eccentric shaft 6 is separated from the line $O_1$ by a predetermined eccentric distance $L_1$. A center axis line $O_3$ of the bushing 8 is defined as the same center axis line of the scroll 12. The line $O_3$ is separated from the line $O_2$ by the predetermined eccentric distance $L_2$. Since the bushing 8 is rotatably fitted on the shaft 6, the distance r between the line $O_1$ of the shaft 4 and the line $O_2$ of the scroll 12 is variable. This variable distance r is the radius of the orbit made by the scroll 12 where the line $O_1$ is the center of the shaft 4. The radius r of the orbit made by the scroll 12 absorbs both the manufacturing tolerance of the spiral members 1*b* and 12*b* of the scrolls 1 and 12 as well as the assembly tolerance of the compressor. This radius r should be automatically adjusted in order to prevent the spiral members 1*b* and 12*b* from being damaged due to occasional abnormally high pressure generated when the compressor is initiated and when the compression chamber P thereof is filled with the liquid refrigerant gas. Thus, an automatic adjusting mechanism for the radius r is provided in the balancing weight 7 and the bushing 8 which will be described hereafter.

Figure 2:
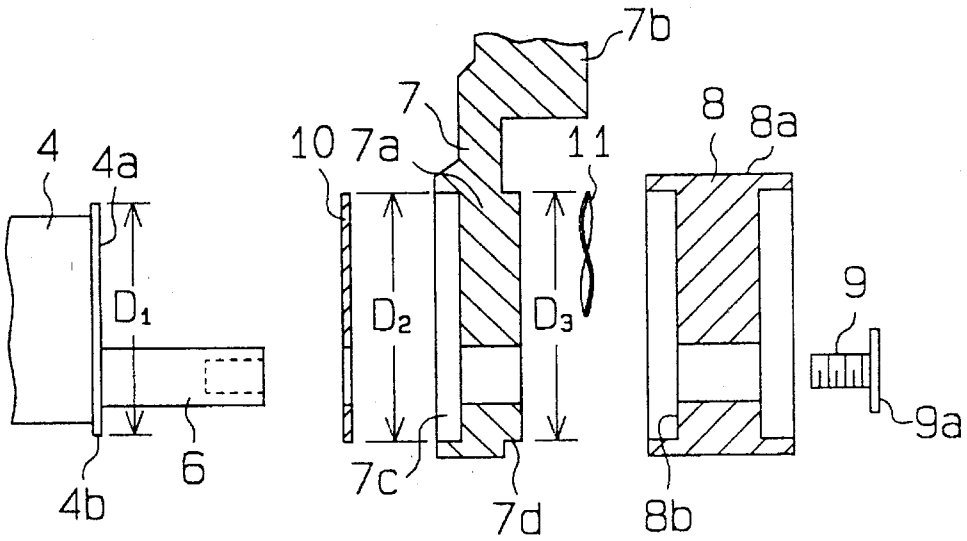
FIG. 2 is a disassembled view in cross-section, showing the essential portions.
Figure 7:
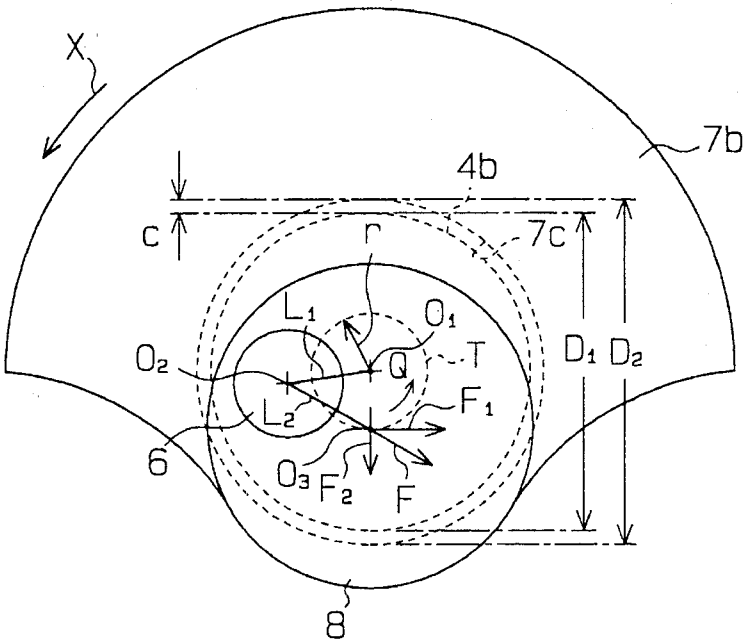
FIG. 7 is a front view showing a balancing weight and bushing.

As shown in FIGS. 2 and 7, a flange 4*b* having a generally circular shape with a diameter $D_1$ is formed at the end portion of the shaft 4, the center of which is the line $O_1$. A recess 7*c* having a diameter $D_2$ larger than a diameter $D_1$ is formed at the first side surface of the ring member 7*a* corresponding to the balancing weight 7 which in turn is loosely engaged on the flange 4*b*. A protrusion 7*d* having a diameter $D_3$ is formed at the second side surface of the ring member 7*a* of the balancing weight 7. A recess 8*b* having a diameter $D_3$ is formed at the first side surface of the bushing 8. As the protrusion 7*d* engages within the recess 8*b*, the weight 7 and the bushing 8 synchronously rotate around the shaft 6, within the small angular region corresponding to the clearance C (See FIG. 7), i.e., one half of the difference between the diameters $D_1$ and $D_2$.

As shown in FIGS. 6 and 7, when the eccentric shaft 6 rotates around the axis line $O_1$ of the rotary shaft 4 in a direction indicated by an arrow X, the orbiting scroll 12 is made to rotate along the circular locus T having the axis line $O_1$ at the center of the rotary shaft 4 with a radius r. Rotation of the orbiting scroll 12 is facilitated by the bushing 8 under a condition where the self rotation of the orbiting scroll 12 around its axis is prevented. An urging force F as shown in FIG. 7 acts on the bushing 8, i.e., the axis line $O_3$ of the scroll 12 and results in the orbital movement of the eccentric shaft 6. This urging force F is divided into two component forces $F_1$ and $F_2$. The component force $F_1$ acts along the direction parallel to the tangential line of the circular locus T. The component force $F_2$ acts along the direction perpendicular to the tangential line. The component force $F_1$ causes the orbiting scroll 12 to make an orbital movement. The component force $F_2$ acting along the direction perpendicular to the tangential line urges the spiral member 12*b* of the scroll 12 against the spiral member 1*b* of the scroll 1, such that the sealing tightness between the contacting portions of the spiral members 1*b* and 12*b* is securely and desirably maintained.

When the scroll 12 receives an abnormally high compression reaction force, generated by the compression of the refrigerant gas in the compression chamber P, the balancing weight 7 and bushing 8 rotate slightly around the eccentric shaft 6 in an orbital movement wherein the radius r gradually decreases, i.e., along the direction indicated by an arrow Q in FIG. 7. Since the radius r is automatically adjusted, the damage to the spiral members 1*b* and 12*b* caused by the compression of the refrigerant gas can be prevented.

As shown in FIG. 6, each of the mutually corresponding pockets 15*a* and 16*a* has the similar diameter $H_2$. As a diameter $H_2$ of each roller 17 is smaller than the diameter $H_1$, a radius r of the orbital movement of the orbiting scroll 12 is approximately determined by doubling the difference between diameter $H_2$ and the diameter $H_1$ (i.e., $\{2\times(H_1-H_2)$). Since the diameters $H_1$, $H_2$ and radius r are set in accordance with the above-described manner, the scroll 12 makes a motion along the circular locus on the radius r, without self rotation around its axis $O_3$. As shown in FIG. 6, when the upper limit of the pocket 16*a* disposed at the leftmost side of the movable ring 16 engages the bottom limit of the pocket 15*a* of the fixed ring 15, and when the ring 16 is shifted to the bottommost position, any rotational shift of the ring 16 in the clockwise direction is prevented. As shown in FIG. 6, shifting the upper limit of the pocket 16*a* is prevented by the bottom limit of the pocket 15*a* disposed at the fixed side by means of the associated roller 17. This prevents rotational shift of the ring 16 in a clockwise direction.

Therefore, self rotation of the scroll 12 is prevented. The scroll 12 is permitted to move only along the circular locus. Since the maximum radial distance of the scroll 12 is set according to the diameters $H_1$ of both pockets 15*a* and 16*a* and the diameter $H_2$ of the rollers, 17 the self adjustment of the radius r is made within the maximum allowable dimension.

As the eccentric shaft 6 makes an orbital movement around the center axis line $O_1$ of the rotary shaft 4, the orbiting scroll 12 makes an orbital movement around the center axis line $O_1$. The refrigerant gas is introduced through an intake port (not shown) into the compression chamber P defined between the interfitted scrolls 1 and 12. As shown in FIG. 5, the volume of the compression chamber P decreases as the rotation of the scroll 12 progresses and converges to the tip portions of the spiral members 1*b* and 12*b* of the scrolls 1 and 12, respectively. The refrigerant gas is compressed as the volume of the compression chamber P decreases, and is then discharged through the discharge port 1*c* formed in the base plate 1*a* shown in FIG. 4 into a discharge chamber 18. The discharge port 1*c* is releasably shut off by means of a discharge valve 19.

Figure 1:
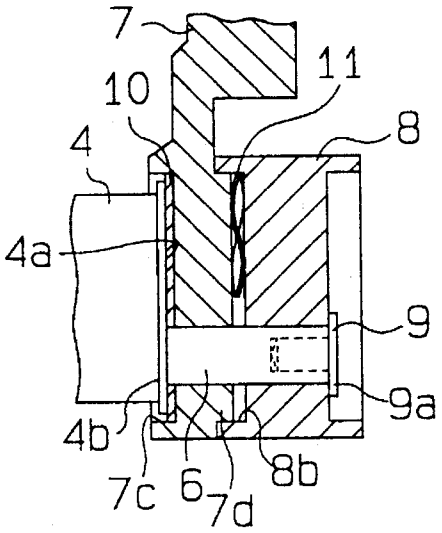
FIG. 1 is a cross-sectional view showing essential portions of a scroll type compressor according to the first embodiment of the present invention.

According to the above-described embodiment, as shown in FIG. 1, a preload generated by the spring 11 is applied on the balancing weight 7 and bushing 8 along the thrust direction between the rotary shaft 4 and the flange 9*a* of the screw 9. Although the radius of the orbital movement made by the scroll 12 is automatically adjusted, as the balancing weight 7 and bushing 8 undergo a slight rotational shift around the eccentric shaft 6, the reciprocal vibrations in the thrust direction are prevented even when the scroll 12 makes an orbital movement, such that the generation of noise is also prevented. As a result, when the invented scroll type compressor is employed in a vehicular air conditioning system, the noise in the engine area is significantly reduced such that comfortable driving conditions can be achieved.

According to this embodiment, as the preload thrust is applied by spring 11 to the balancing weight 7, sliding friction may be generated between the inner end surface 4*a* of the rotary shaft 4 and the ring member 7*a* of the balancing weight 7. Spacer 10 made with a material having a low coefficient of friction reduces this sliding friction and as such, the slight rotational shift of the weight 7 and the bushing 8 can be smoothly carried out when the radius r of the circular locus is automatically adjusted.

Although only one embodiment of the present invention has been described in detail herein, it should be apparent to those skilled in the art that the present invention may be embodied in many other specific forms without departing from the spirit or scope of the invention. Particularly, it should be understood that the invention may be practiced according to the following modes.

Figure 9:
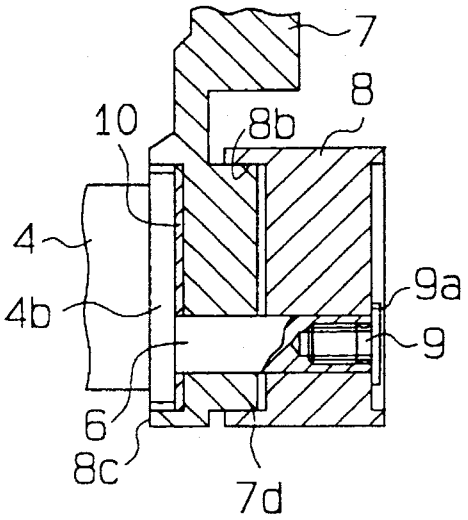
FIG. 9 is a cross-sectional view showing the assembled components of FIG. 8.
Figure 8:
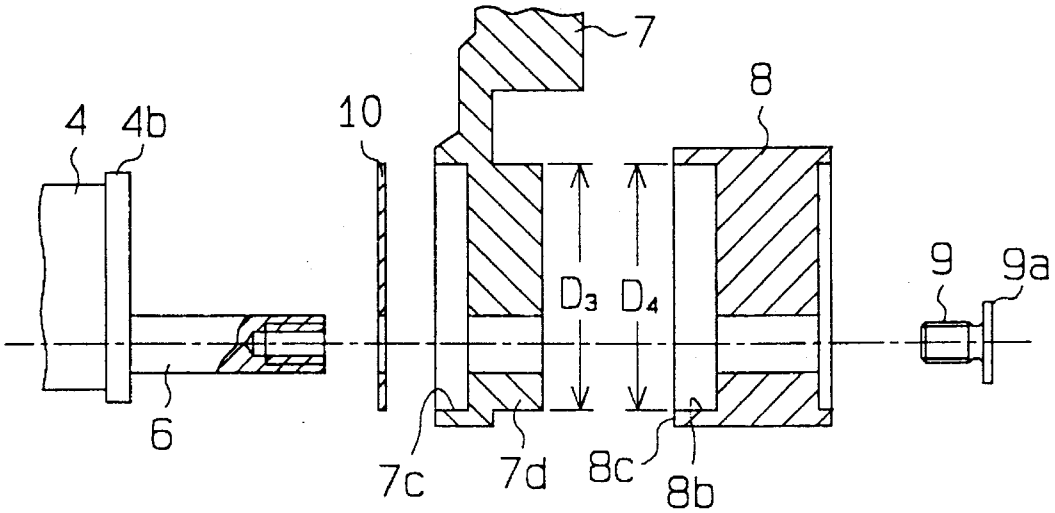
FIG. 8 is a disassembled cross-sectional view of another example of the present invention.

(1) As shown in FIGS. 8 and 9, the diameter D, of the protrusion 7*d* of the balancing weight 7 is made slightly larger than the diameter $D_4$ of the recess 8*b* corresponding to the bushing 8. As shown in FIG. 9, the protrusion 7*d* is forcibly urged against the recess 8*b* so as to elastically deform or expand a ring portion 8*c* outwardly by tightening the screw 9. Therefore, the protrusion 7*d* is forcibly fitted into the recess 8*b*. If this structure is employed, the forcibly fitted structure of the balancing weight 7 and the bushing 8 acts as a mechanism that prevents self-rotation.

Figure 10:
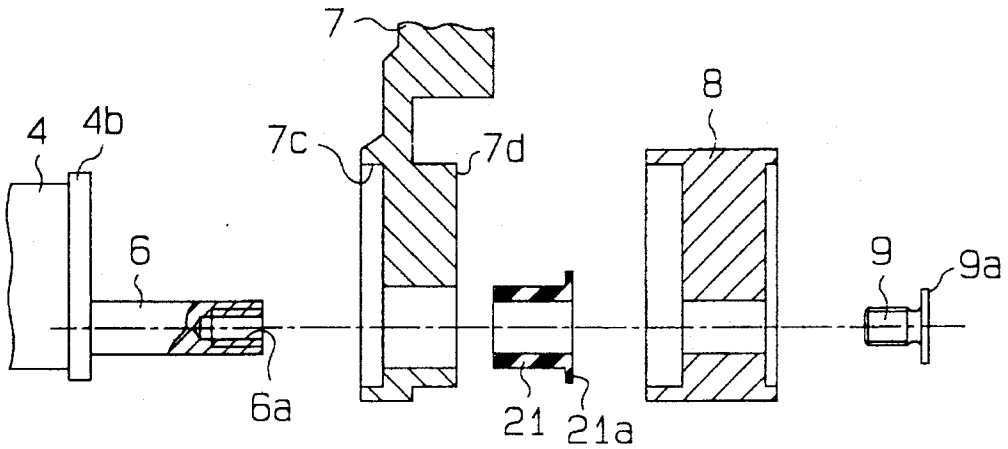
FIG. 10 is another disassembled cross-sectional view of another example of the present invention.
Figure 11:
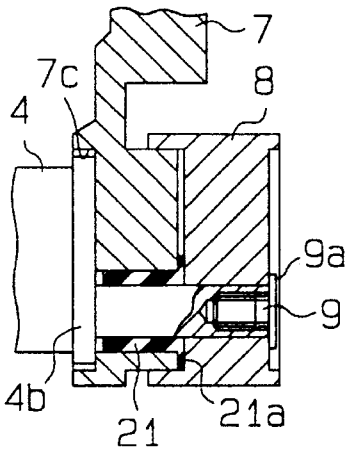
FIG. 11 is a cross-sectional view showing the assembled components of FIG. 10.
Figure 13:
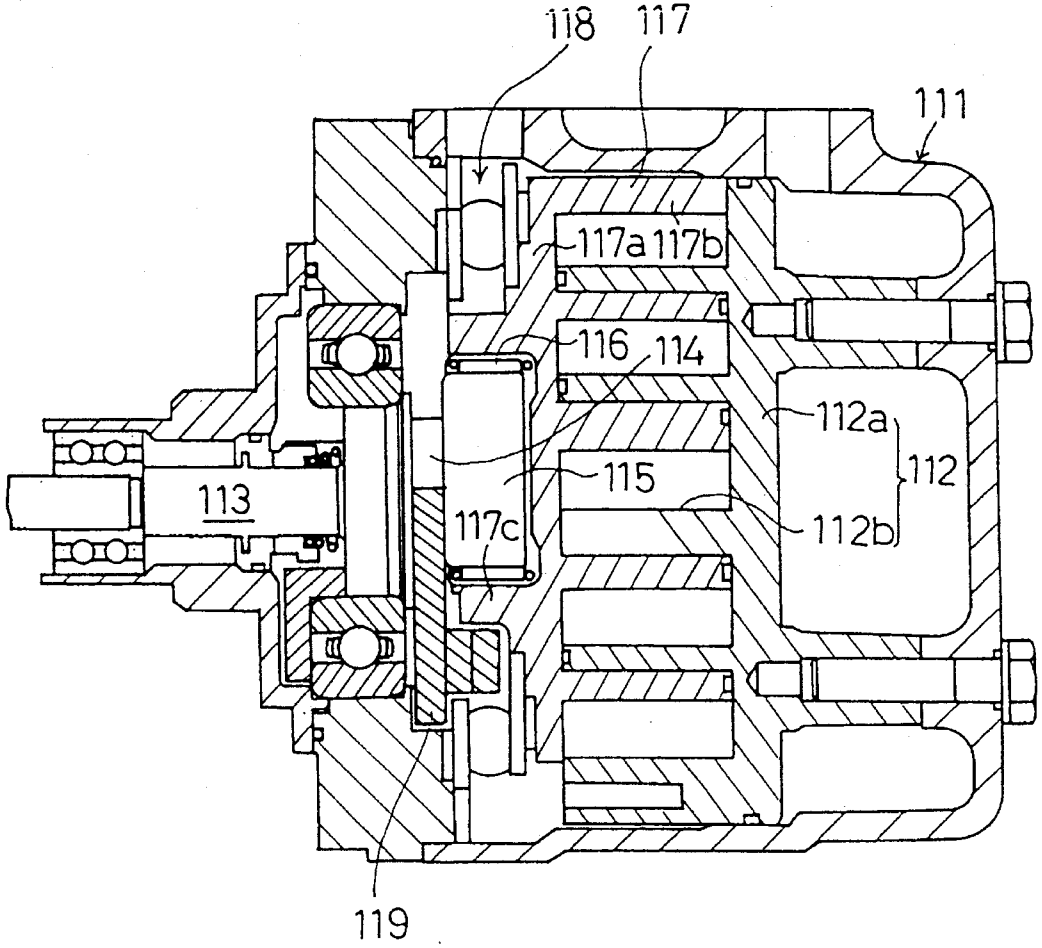
FIG. 13 (PRIOR ART)
FIG. 13 is a cross-sectional view of a conventional scroll type compressor.
Figure 14:
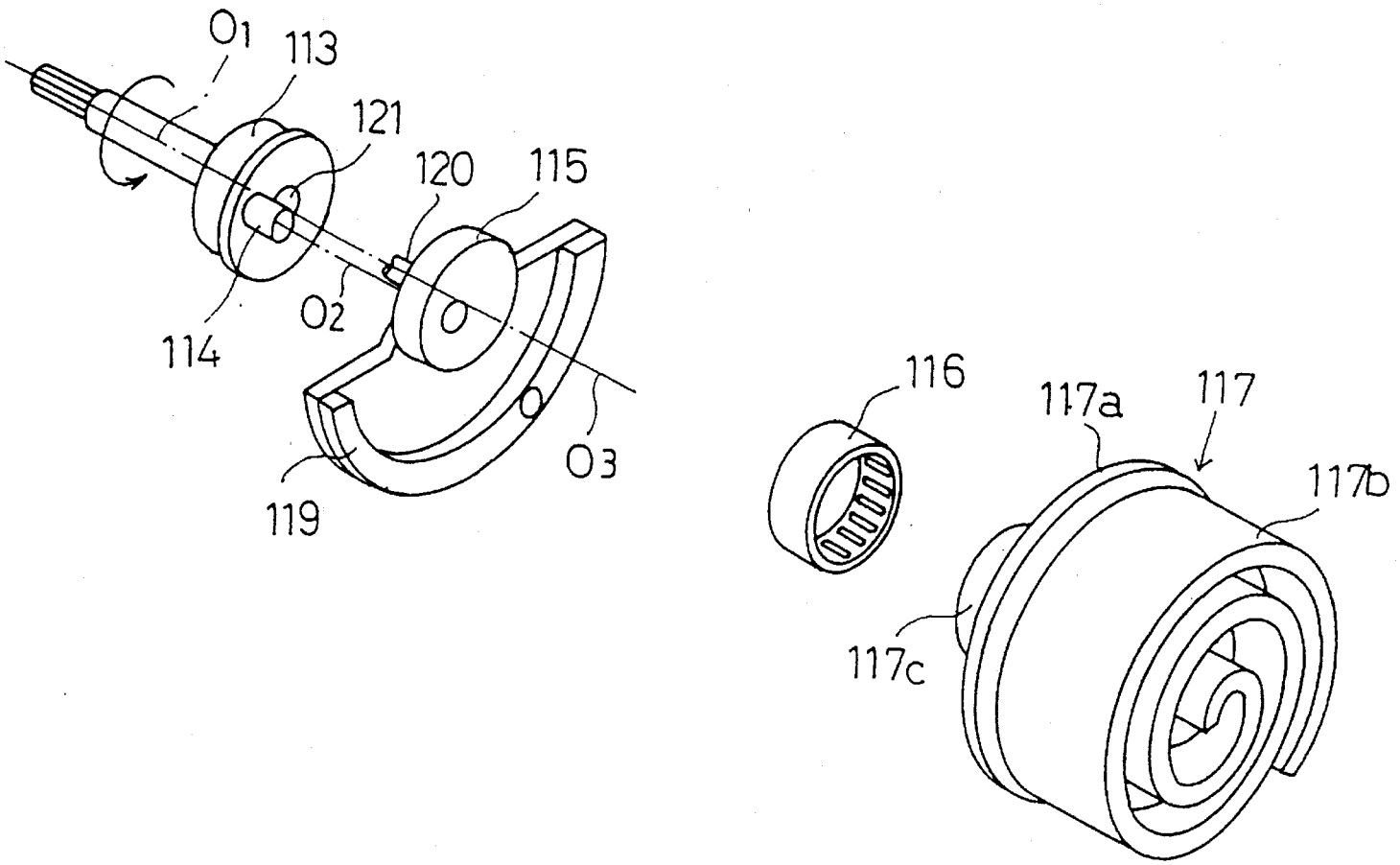
FIG. 14 (PRIOR ART)
FIG. 14 is a disassembled view in perspective showing a conventional rotary shaft, balancing weight and orbiting scroll.
Figure 17:
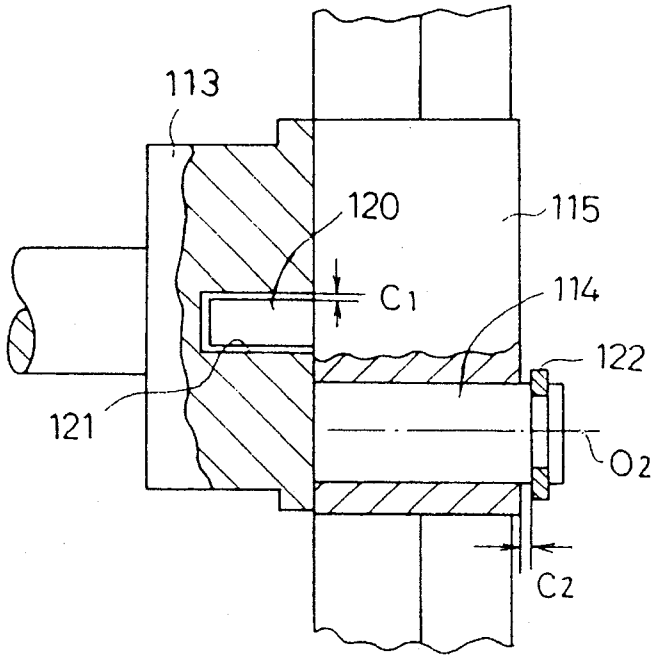
FIG. 17 (PRIOR ART)
FIG. 17 is a cross-sectional view showing the conventionally assembled structure of the bushing with respect to the eccentric shaft.
Figure 15:
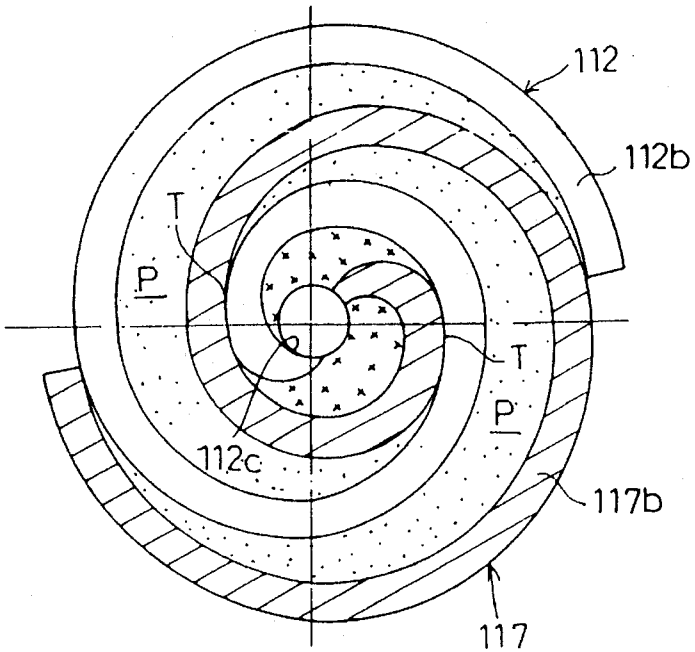
FIG. 15 (PRIOR ART)
FIG. 15 is a cross-sectional view illustrating the way that the spiral members of the fixed and orbiting scrolls conventionally nestle and interfit with each other.
Figure 16:
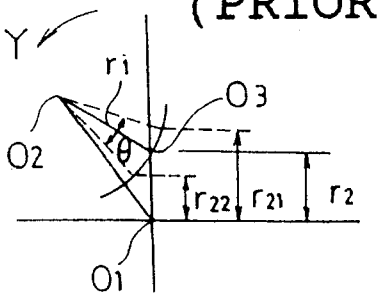
FIG. 16 (PRIOR ART)
FIG. 16 is an explanatory drawing showing the conventional way to adjust the radius with which the orbiting scroll moves along.

(2) As shown in FIGS. 10 and 11, an elastic sleeve 21 having an end surface 21 is fitted over the periphery of the eccentric shaft 6, and the balancing weight 7 is fitted over the periphery of the sleeve 21 with the end surface 21*a* projecting outwardly from the weight 7 as shown. A preload is applied in the thrust direction on the weight 7 and the bushing 8 which is caused by the urging force on the sleeve 21 by the bushing 8 urged by the screw flange 9*a* when the screw 9 is tightened.

Figure 12:
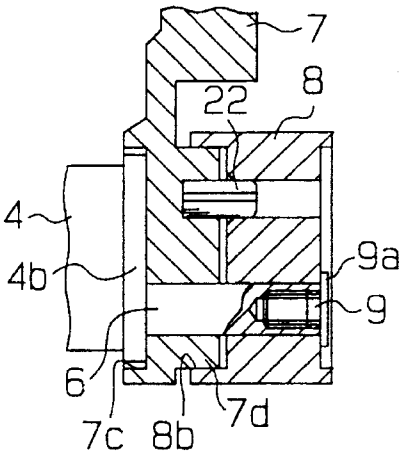
FIG. 12 is yet another a cross-sectional view showing the assembled components of yet another example of the invention.

(3) As shown in FIG. 12, when a split ring spring pin 22 serving as a resilient member is forcibly inserted in respective bores in, and interposed between the balancing weight 7 and the bushing 8, a frictional preload can be applied by the radially outward spring force of pin 22 on the weight 7 and the bushing 8. The frictional force prevents weight 7 and bushing 8 from moving in axial direction on the shaft 6.

Therefore, the present examples and embodiments are to be considered as illustrative and not restrictive and the invention is not to be limited to the details given herein, but may be modified within the scope of the appended claims.

What is claimed is:

1. A scroll type compressor having a fixed scroll, a rotary shaft having an eccentric shaft thereon, a bushing eccentrically mounted for rotatable movement on said eccentric shaft, a moveable scroll mounted for rotatable movement on said bushing and interfitting with said fixed scroll to form a compression chamber therebetween, said moveable scroll having an anti-self-rotation mechanism thereon to provide orbital movement of said moveable scroll on said fixed scroll responsive to rotation of said rotary shaft for reducing the volume of said compression chamber and thereby compressing gas therein, means for adjusting the radius of said orbital movement of said moveable scroll, a balancing weight mounted on said eccentric shaft to compensate for dynamic imbalance due to centrifugal force produced by said orbital movement of said moveable scroll, means for retaining said bushing and said weight on said eccentric shaft, and means for resiliently absorbing thrusting movement of said bushing and said weight on said eccentric shaft.

2. A scroll-type compressor according to claim 1, wherein said eccentric shaft has an end surface, and said means for retaining said bushing and said weight on said eccentric shaft comprises a screw threaded into said end surface of said eccentric shaft, said screw having a flange thereon engaging said bushing.

3. A scroll-type compressor according to claim 1, wherein said means for absorbing thrusting movement comprises a spring disposed between said weight and said bushing.

4. A scroll-type compressor according to claim 3, wherein said rotary shaft has an end surface co-facing said weight, and which further comprises a spacer having respectively opposite abrasively resistant surfaces between said rotary shaft end surface and said weight.

5. A scroll-type compressor according to claim 1, wherein said means for absorbing thrusting movement comprises an elastic sleeve mounted on said eccentric shaft and supporting said weight thereon, said sleeve having an end surface projecting outwardly from said weight toward said bushing, and means urging said bushing against said projecting end surface of said sleeve.

6. A scroll-type compressor according to claim 1, wherein said means for absorbing thrusting movement comprises means defining respective and axially aligned bores in said weight and said bushing, and a spring pin mounted in and extending between said bores and frictionally engaging said weight and said bushing.

7. A scroll-type compressor having a fixed scroll, a rotary shaft having an eccentric shaft thereon, a bushing eccentrically mounted for rotatable movement on said eccentric shaft, a moveable scroll mounted for rotatable movement on said bushing and interfitting with said fixed scroll to form a compression chamber therebetween, said moveable scroll having an anti-self-rotation mechanism thereon to provide orbital movement of said moveable scroll on said fixed scroll responsive to rotation of said rotary shaft for reducing the volume of said compression chamber and thereby compressing gas therein, means for adjusting the radius of said orbital movement of said moveable scroll, a balancing weight mounted on said eccentric shaft to compensate for dynamic imbalance due to centrifugal force produced by said orbital movement of said moveable scroll, said weight having a side surface and an opposite side surface and said rotary shaft having an end surface co-facing said side surface of said weight, said opposite side surface of said weight co-facing said bushing, means for retaining said bushing and said weight on said eccentric shaft, means for resiliently absorbing thrusting movement of said bushing and said weight on said eccentric shaft, and a spacer having respectively opposite abrasively resistant surfaces disposed between said rotary shaft end surface and said side surface of said weight.

8. A scroll-type compressor according to claim 7, wherein said spacer is of material having low wear rate and high ductility selected from the group consisting of polytetrafluoroethylene and gun metal.

9. A scroll-type compressor according to claim 7, wherein said means for absorbing thrusting movement comprises a spring disposed between said weight and said bushing.

10. A scroll-type compressor according to claim 7, wherein said means for absorbing thrusting movement comprises an elastic sleeve mounted on said eccentric shaft and supporting said weight thereon, said sleeve having an end surface projecting outwardly from said opposite side of said weight, and means urging said bushing against said projecting end surface of said sleeve.

11. A scroll type compressor according to claim 7, wherein said means for absorbing thrusting movement comprises means defining respective and axially aligned bores in said weight and said bushing, and a spring pin mounted in and extending between said bores and frictionally engaging said weight and said bushing.

12. A scroll-type compressor having a fixed scroll, a rotary shaft having an eccentric shaft thereon, a bushing eccentrically mounted for rotatable movement on said eccentric shaft, a moveable scroll mounted for rotatable movement on said bushing and interfitting with said fixed scroll to form a compression chamber therebetween, said moveable scroll having an anti-self-rotation mechanism thereon to provide orbital movement of said moveable scroll on said fixed scroll responsive to rotation of said rotary shaft for reducing the volume of said compression chamber and thereby compressing gas therein, means for adjusting the radius of said orbital movement of said moveable scroll, a balancing weight mounted on said eccentric shaft to compensate for dynamic imbalance due to centrifugal force produced by said orbital movement of said moveable scroll, said weight having a side surface and an opposite side surface and said rotary shaft having an end surface co-facing said side surface of said weight, said opposite side surface of said weight co-facing said bushing, means for retaining said bushing and said weight on said eccentric shaft, and means for resiliently absorbing thrusting movement of said bushing and said weight on said eccentric shaft during said orbital movement of said moveable scroll, said absorbing means comprising an outwardly projecting portion on said opposite side surface of said weight and means defining a recess in said bushing receiving said projecting portion on said weight and having a resiliently deformable ring portion around said recess, said recess being slightly smaller than said outwardly projecting portion on said weight whereby said projecting portion is resiliently received within said ring portion.

13. A scroll type compressor according to claim 12, which further comprises a spacer having respectively opposite abrasively resistant surfaces between said rotary shaft end surface and the first said side surface of said weight.

* * * * *